United States Patent [19]

Radwanski et al.

[11] Patent Number: 4,939,016

[45] Date of Patent: Jul. 3, 1990

[54] HYDRAULICALLY ENTANGLED NONWOVEN ELASTOMERIC WEB AND METHOD OF FORMING THE SAME

[75] Inventors: Fred R. Radwanski, Norcross, Ga.; Lloyd E. Trimble, Dustin, Okla.; Roland C. Smith, Gainesville, Ga.; Cherie H. Everhart, Alpharetta, Ga.; Deborah A. Kimmitt, Demarest, Ga.

[73] Assignee: Kimberly-Clark Corporation, Neenah, Wis.

[21] Appl. No.: 170,209

[22] Filed: Mar. 18, 1988

[51] Int. Cl.[5] ..... D06N 7/04

[52] U.S. Cl. ..... 428/152; 28/104; 428/182; 428/283; 428/284; 428/297; 428/298; 428/299; 428/326; 428/327; 428/903; 428/913

[58] Field of Search ..... 428/181, 182, 152, 153, 428/283, 284, 288, 297, 298, 299, 300, 326, 903, 913, 327; 28/104

[56] References Cited

U.S. PATENT DOCUMENTS

| | | | |
|---|---|---|---|
| 3,485,706 | 12/1969 | Evans | 161/72 |
| 3,493,462 | 2/1970 | Bunting et al. | 161/169 |
| 3,494,821 | 2/1970 | Evans | 161/169 |
| 3,498,874 | 3/1970 | Evans | 161/109 |
| 4,209,563 | 6/1980 | Sisson | 428/288 |
| 4,426,420 | 1/1984 | Likhani | 428/224 |
| 4,426,421 | 1/1984 | Nakamae et al. | 428/234 |
| 4,442,161 | 4/1984 | Kirayoglu | 428/219 |
| 4,476,186 | 10/1984 | Hato et al. | 428/299 |
| 4,515,854 | 5/1985 | Kogame et al. | 428/299 |
| 4,532,173 | 7/1985 | Suzuki et al. | 428/218 |
| 4,537,819 | 8/1985 | Schortmann et al. | 428/284 |
| 4,591,513 | 5/1986 | Suzuki | 427/200 |
| 4,612,228 | 9/1986 | Hato et al. | 428/299 |
| 4,681,801 | 7/1987 | Evan et al. | 428/299 |
| 4,692,368 | 9/1987 | Taylor et al. | 428/299 |
| 4,707,398 | 11/1987 | Boggs | 428/903 |
| 4,720,415 | 1/1988 | Vander Wielen et al. | 428/298 |
| 4,724,184 | 2/1988 | William et al. | 428/903 |
| 4,734,311 | 3/1988 | Sokolowski | 428/903 |
| 4,741,949 | 5/1988 | Morman et al. | 428/903 |
| 4,808,467 | 2/1989 | Suskind et al. | 428/284 |
| 4,818,594 | 4/1989 | Albien et al. | 428/244 |

FOREIGN PATENT DOCUMENTS

| | | |
|---|---|---|
| 108621 | 5/1984 | European Pat. Off. . |
| 128667 | 5/1984 | European Pat. Off. . |
| 1544165 | 4/1979 | United Kingdom . |
| 1550955 | 8/1979 | United Kingdom . |
| 2085493 | 4/1982 | United Kingdom . |

OTHER PUBLICATIONS

"Progress with Sontara and Spunlaced Fabrics in Europe" Nonwovens Report Jan. 78 pp. 7–8.

"Composite of Synthetic-Fiber Web and Paper" Research Disclosure No. 09196/78 Jun. 1978.

"Inda Looks Into the Future of Nonwoven Fabrics" Inda-Tec Nonwovens Technology Conference Jun. 2–5, 1986, p. 5.

"Suominen Offers Wide Range of Spunlaced Nonwovens" vol. 12 No. 6 European Disposables and Nonwovens Assoc. Newsletter Nov./Dec. 1986.

"The Perfojet Entanglement Process" Andre Vuillaume Nonwovens World Feb. 1987 pp. 81–84.

"Burlington Tries Polyester/Cotton Spunlace" Nonwovens World May–Jun. 1987 pp. 19 and 21.

"First Weaving, Then Knitting, Now Spunlaced Nonwovens" Nonwovens Industry Jul. 1987 pp. 32, 34 and 35.

"Water Jet Entangled Nonwovens" John R. Starr Insight 87 9-21-87 pp. 1–20.

"Spunlaced Products: Technology and End-Use Applications" E. I. du Pont de Nemours & Company Inc. Section XII.

*Primary Examiner*—James J. Bell

*Attorney, Agent, or Firm*—Karl V. Sidor

[57] ABSTRACT

A composite nonwoven elastomeric web material, and method of forming such material, as well as a nonwoven elastomeric web material and method of forming such material, are disclosed. The composite web material is provided by hydraulically entangling a laminate of at least (1) a layer of meltblown fibers; and (2) at least one further layer, preferably of at least one of pulp fibers, staple fibers, meltblown fibers, and continuous filaments, with or without particulate material, with at least one of the layer of meltblown fibers and the further layer being elastic so as to form an elastic web material after hydraulic entanglement. The nonwoven elastomeric web material is provided by hydraulically entangling a layer of meltblown elastomeric fibers. The material formed can be cloth-like with smooth surfaces, and with isotropic elasticity and strength. Different texture properties, including a corrugated stretchable fabric, can be provided by pre-stretching and then hydraulically entangling while stretched.

40 Claims, 4 Drawing Sheets

HYDRAULICALLY ENTANGLED NONWOVEN ELASTOMERIC WEB AND METHOD OF FORMING THE SAME

BACKGROUND OF THE INVENTION

The present invention relates to nonwoven elastomeric web material and, particularly, to nonwoven fibrous elastomeric web material including meltblown elastic webs, with or without various types of fibers. More particularly, the present invention relates to meltblown elastic webs made cloth-like by hydraulically entangle bonding them, either by themselves or with various types of fibrous material and composites, such as pulp fibers (synthetic and natural pulp fibers, including wood pulp fibers), staple fibers such as vegetable fibers, cotton fibers (e.g., cotton linters) and flax, etc., other meltblown fibers, coform materials, and continuous filaments. Moreover, the present invention is directed to methods of forming such nonwoven elastomeric web material. These materials have a wide range of applications, from cheap disposable cover stock for, e.g., disposable diapers to wipes and durable nonwovens.

It has been desired to provide a nonwoven elastomeric material that has high strength and isotropic elastic properties, and that is cloth-like and has smooth surfaces, having good feel and drape.

U S. Pat. No. 4,209,563 to Sisson discloses a method of making an elastic material, and the elastic material formed by such method, the method including continuously forwarding relatively elastomeric filaments and elongatable but relatively non-elastic filaments onto a forming surface and binding at least some of the fiber crossings to form a coherent cloth which is subsequently mechanically worked, as by stretching, following which it is allowed to relax; the elastic modulus of the cloth is substantially reduced after the stretching resulting in the permanently stretched non-elastic filaments relaxing and looping to increase the bulk and improve the feel of the fabric. Forwarding of the filaments to the forming surface is positively controlled, which the patentee contrasts to the use of air streams to convey the fibers as used in meltblowing operations. Bonding of the filaments to form the coherent cloth may utilize embossing patterns or smooth, heated roll nips.

U.S. Pat. No. 4,426,420 to Likhyani discloses a nonwoven fabric having elastic properties and a process for forming such fabric, wherein a batt composed of at least two types of staple fibers is subjected to a hydraulic entanglement treatment to form a spunlaced nonwoven fabric. For the purpose of imparting greater stretch and resilience to the fabric, the process comprises forming the batt of hard fibers and of potentially elastic elastomeric fibers, and after the hydraulic entanglement treatment heat-treating the thus produced fabric to develop elastic characteristics in the elastomeric fibers. The preferred polymer for the elastomeric fibers is poly (butylene terephthalate)-co-poly-(tetramethyleneoxy) terephthalate. The hard fibers may be of any synthetic fiber-forming material, such as polyesters, polyamides, acrylic polymers and copolymers, vinyl polymers, cellulose derivatives, glass, and the like, as well as any natural fibers, such as cotton, wool, silk, paper and the like, or a blend of two or more hard fibers, the hard fibers generally having low stretch characteristics as compared to the stretch characteristics of the elastic fibers. This patent further discloses that the batt of the mixture of fibers that is hydraulically entangled can be formed by the procedures of forming fibers of each of the materials separately, and then blending the fibers together, the blend being formed into a batt on a carding machine.

U.S. Pat. No. 4,591,513 to Suzuki et al discloses a fiber-implanted nonwoven fabric, and method of producing such nonwoven fabric, wherein a fibrous web consisting of fibers shorter than 100 mm is laid upon a foamed and elastic sheet of open pore type having a thickness less than 5 mm, with this material then being subjected to hydraulic entangling while the foamed sheet is stretched by 10% or more, so that the short fibers of the fibrous web may be implanted deeply into the interior of the foamed sheet and not only mutually entangled on the surface of the fibrous web but also interlocked with material of the foamed sheet along the surface as well as in the interior of the foamed sheet. The short fibers can include natural fibers such as silk, cotton and flax, regenerated fibers such as rayon and cupro-ammonium rayon, semi-synthetic fibers such as acetate and premix, and synthetic fibers such as nylon, vinylon, vinylidene, vinyl chloride, polyester, acryl, polyethylene, polypropylene, polyurethane, benzoate and polyclar. The foamed sheet may be of foamed polyurethane.

U.S. Pat. No. 3,485,706 to Evans discloses a textile-like nonwoven fabric and a process and apparatus for its production, wherein the fabric has fibers randomly entangled with each other in a repeating pattern of localized entangled regions interconnected by fibers extending between adjacent entangled regions. The process disclosed in this patent involves supporting a layer of fibrous material on an apertured patterning member for treatment, jetting liquid supplied at pressures of at least 200 pounds per square inch (psi) gauge to form streams having over 23,000 energy flux in foot-pounds/inch$^2$. second at the treatment distance, and traversing the supported layer of fibrous material with the streams to entangle fibers in a pattern determined by the supporting member, using a sufficient amount of treatment to produce uniformly patterned fabric. (Such technique, of using jetting liquid streams to entangle fibers in forming a bonded web material, is called hydraulic entanglement.) The initial material is disclosed to consist of any web, mat, batt or the like of loose fibers disposed in random relationship with one another or in any degree of alignment. The initial material may be made by desired techniques such as by carding, random lay-down, air or slurry deposition, etc.; and may consist of blends of fibers of different types and/or sizes, and may include scrim, woven cloth, bonded nonwoven fabrics, or other reinforcing material, which is incorporated into the final product by the hydraulic entanglement. This patent discloses the use of various fibers, including elastic fibers, to be used in the hydraulic entangling. In Example 56 of this patent is illustrated the preparation of nonwoven, multi-level patterned structures composed of two webs of polyester staple fibers which have a web of spandex yarn located therebetween, the webs being joined to each other by application of hydraulic jets of water which entangle the fibers of one web with the fibers of an adjacent web, with the spandex yarn being stretched 200% during the entangling step, thereby providing a puckered fabric with high elasticity in the warp direction.

U.S. Pat. No. 4,426,421 to Nakamae et al discloses a multi-layer composite sheet useful as a substrate for artificial leather, comprising at least three fibrous layers, namely, a superficial layer consisting of spun-laid extremely fine fibers entangled with each other, thereby forming a body of a nonwoven fibrous layer; an intermediate layer consisting of synthetic staple fibers entangled with each other to form a body of nonwoven fibrous layer; and a base layer consisting of a woven or knitted fabric. The composite sheet is disclosed to be prepared by superimposing the layers together in the aforementioned order and, then, incorporating them together to form a body of composite sheet by means of a needle-punching or water-stream-ejecting under a high pressure. This patent discloses that the spun-laid extremely fine fibers can be produced by a meltblown method.

While the above-discussed documents disclose products and processes which exhibit some of the characteristics or method steps of the present invention, none discloses or suggests the presently claimed process or the product resulting therefrom, and none achieves the advantages of the present invention. In particular, notwithstanding the various processes and products described in these documents, it is still desired to provide a nonwoven elastomeric web material having high strength and isotropic elastic properties, and which can have a smooth, cloth-like surface. It is further desired to provide such a nonwoven elastomeric web, wherein different texture and patterning properties can be achieved. Furthermore, it is also desired to provide such material, utilizing a process which is simple and relatively inexpensive.

SUMMARY OF THE INVENTION

Accordingly, it is an object of the present invention to provide a nonwoven elastomeric material (e.g., a nonwoven fibrous elastomeric web material, such as a nonwoven fibrous elastomeric web) having high web strength, including isotropic web strength, and isotropic elastic properties, and methods for forming such material.

It is a further object of the present invention to provide a nonwoven fibrous elastomeric web material having such strength and elastic properties, and that is cloth-like and can have a smooth surface.

It is a further object of the present invention to provide such a nonwoven fibrous elastomeric material, having such strength and isotropic elastic properties, and wherein different textural and patterning properties can be provided for the material.

It is a further object of the present invention to provide a nonwoven fibrous elastomeric material that has such strength and elastic properties, and that is durable and drapable.

The present invention achieves each of the above objects by providing a composite nonwoven elastomeric material formed by hydraulically entangling a laminate comprising (1) a layer of meltblown fibers, and (2) at least one further layer, with at least one of the meltblown fiber layer and the further layer being elastic. Preferably, the layer of meltblown fibers is an elastomeric web of meltblown fibers, such as an elastomeric web of meltblown fibers of a thermoplastic elastomeric material. Preferably, the at least one further layer is constituted by at least one of pulp fibers (e.g., wood pulp fibers), staple fibers, meltblown fibers (including, e.g., coformed webs), and continuous filaments, with or without particulate material.

Moreover, the present invention achieves the above objects by hydraulically entangling at least one meltblown elastic web (e.g., a single meltblown elastic web). Thus, within the scope of the present invention is a nonwoven entangle bonded material formed by providing a meltblown elastic web (that is, a single web of meltblown fibers of a single elastomeric material, including a single blend of materials), and hydraulically entangling the meltblown fibers of the web (e.g., wherein meltblown fibers of the web entangle and intertwine with other meltblown fibers of the web, including bundles of meltblown fibers of the web), and a method of forming such material.

By providing a laminate of a meltblown elastic web with at least one layer of, e.g., wood pulp fibers, staple fibers, meltblown fibers (e.g., nonelastic or elastic) meltblown fibers) and/or continuous filaments, with or without particulate material, and hydraulically entangling the laminate, the product formed can be cloth-like, avoiding any plastic-like (or rubbery-like) feel of the meltblown elastic webs. In addition, by utilizing hydraulic entangle bonding to provide the bonding between the meltblown elastic webs and the fibers and composites, a smooth elastic fabric can be achieved.

Furthermore, by the present invention, the need to pre-stretch the meltblown elastic webs (whereby the elastic web is in a stretched condition during bonding to a further layer, as in stretch-bonded-laminate technology) can be avoided. Accordingly, the bonding process of the present invention is less complex than in, e.g., stretch-bonded-laminate technology. However, by the present invention, the meltblown elastic webs (when having sufficient structural inte grity, e.g., by prior light bonding) can be pre-stretched, to formulate different texture and elastic properties of the formed product. For example, by pre-stretching, a product having a puckered texture can be provided.

Moreover, elasticity of the formed composite product can be modified by pre-entangling (e.g., hydraulic entangling) the elastomeric web of meltblown fibers prior to lamination with the further layer and hydraulic entanglement of the laminate.

Furthermore, the use of meltblown fibers as part of the laminate subjected to hydraulic entangling facilitates entangling of the fibers. This results in a higher degree of entanglement and allows the use of short staple or pulp fibers. Moreover, the use of meltblown fibers can decrease the amount of energy needed to hydraulically entangle the laminate.

In addition, the use of the meltblown fibers provides an improved product in that the entangling and intertwining among the meltblown fibers and the fibrous material of the other layer(s) of the laminate (or among the meltblown elastic fibers of a single web) is improved. Due to the relatively great length, small thickness and high surface friction of the elastic meltblown fibers, wrapping of the other fibers around the elastic meltblown fibers in the web is enhanced. Moreover, the meltblown fibers have a relatively high surface area, small diameters and are a sufficient distance apart from one another to allow, e.g., cellulose fibers to freely move and wrap around and within the meltblown fibers.

In addition, use of meltblown elastic fibers provides improved abrasion resistance, attributed to the increased ability of the meltblown elastic fibers to hold the other material therewith, due to, e.g., the coefficient of friction of the elastic fibers and the elastic properties of the fibers. In addition, due to the relatively long length of the meltblown elastic fibers, the product formed by hydraulic entanglement has better recovery; that is, slippage between hydraulically entangle-bonded fibers would be expected to be less than when, e.g., 100% staple elastic fibers are used.

The use of hydraulic entangling techniques, to mechanically entangle (e.g., mechanically bond) the fibrous material, rather than using only other bonding techniques, including other mechanical entangling techniques such as needle punching, provides a composite nonwoven fibrous web material having improved properties, such as improved strength and drapability, while providing a product having isotropic elastic properties and which is cloth-like and which can have a smooth surface. Moreover, use of hydraulic entangling to provide bonding between the fibers permits dissimilar fibrous material (e.g., materials that cannot be chemically or thermally bonded) to be bonded to form a single web material.

Accordingly, by the present invention, a durable, drapable nonwoven fibrous elastomeric material, having high strength and isotropic elastic properties, being cloth-like and having smooth surfaces, can be achieved, by a relatively simple process.

DETAILED DESCRIPTION OF THE INVENTION

Figure 1:
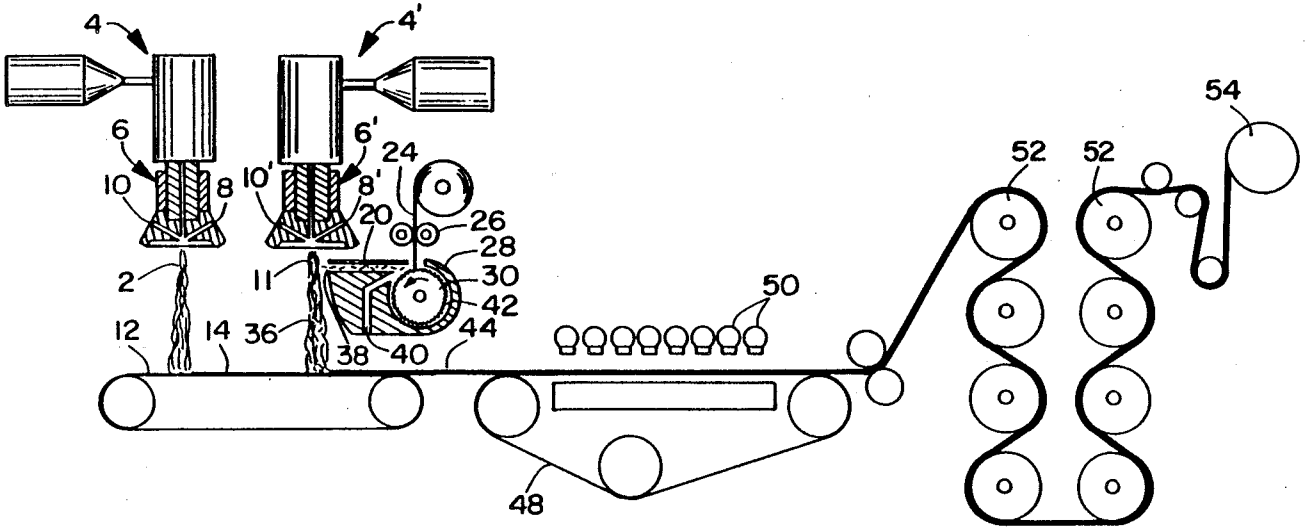
FIG. 1 is a schematic view of an apparatus for forming a composite nonwoven fibrous elastomeric web material of the present invention.

While the invention will be described in connection with the specific and preferred embodiments, it will be understood that it is not intended to limit the invention to those embodiments. On the contrary, it is intended to cover all alterations, modifications and equivalents as may be included within the spirit and scope of the invention as defined by the appended claims.

The present invention contemplates a composite nonwoven elastomeric web of a hydraulically entangled laminate, and a method of forming the same, which involves processing of a laminate of a layer of meltblown fibers and a further layer, with at least one of the layer of meltblown fibers and the further layer being elastic so as to provide a composite material that is elastic after the hydraulic entanglement. The layer of meltblown fibers can be a meltblown elastomeric web, for example. The further layer can include any of various types of nonwoven material, including nonwoven fibrous material such as pulp fibers and/or staple fibers and/or meltblown fibers and/or continuous filaments. Thus, where the further layer consists of meltblown fibers, the laminate can include 100% meltblown fibers (e.g., both nonelastic and elastic meltblown fibers, or 100% elastic meltblown fibers); moreover, the laminate can include reinforcing layers such as netting. The further layer can also be a composite fibrous material, such as a coform, and can also be a layer of knit or woven material. The laminate is hydraulically entangled, that is, a plurality of high pressure liquid columnar streams are jetted toward a surface of the laminate, thereby mechanically entangling and intertwining the meltblown fibers and the other fibers and/or composites of the laminate.

By a laminate of meltblown fibers and a further layer of at least one of pulp fibers, and/or staple fibers, and/or further meltblown fibers and/or continuous filaments, and/or composites such as coforms, we mean a structure which includes at least a layer (e.g., web) including meltblown fibers and a layer including the other material. The fibers can be in the form of, e.g., webs, batts, loose fibers, etc. The laminate can be formed by known means such as forming a layer of elastomeric meltblown fibers and wet-forming or airlaying thereon a layer of fibrous material; forming a carded layer of, e.g., staple fibers and providing such layer adjacent a layer of elastomeric meltblown fibers, etc. The laminate can include layers of other materials.

The present invention also contemplates a nonwoven elastomeric web, of elastomeric meltblown fibers that have been subjected to hydraulic entanglement, and a method of forming the web. In the nonwoven elastomeric web formed, the meltblown fibers, and bundles of such fibers, are mechanically entangled and intertwined to provide the desired mechanical bonding of the web.

The terms "elastic" and "elastomeric" are used interchangeably herein to mean any material which, upon application of a force, is stretchable to a stretched, biased length which is at least about 110% of its relaxed length, and which will recover at least about 40% of its elongation upon release of the stretching, elongating force. For many uses (e.g., garment purposes), a large amount of elongation (e.g., over 12%) is not necessary, and the important criterion is the recovery property. Many elastic materials may be stretched by much more than 25% of their relaxed length and many of these will recover to substantially their original relaxed length upon release of the stretching, elongating force.

As used herein, the term "recover" refers to a contraction of a stretched material upon termination of a force following stretching of the material by application of the force For example, if a material having a relaxed length of one (1) inch was elongated 50% by stretching to a length of 1 and ½ (1.5) inches the material would have a stretched length that is 150% of its relaxed length. If this exemplary stretched material contracted, that is recovered, to a length of 1 and 1/10 (1.1) inches, after release of the stretching force, the material would have recovered 80% (0.4 inch) of its elongation.

As used herein, the term "polymer" includes both homopolymers and copolymers.

As used herein, the term "meltblown fibers" refers to relatively small diameter fibers, which are made by extruding a molten thermoplastic material through a plurality- of fine, usually circular, die capillaries as molten threads or filaments into a high velocity gas (e.g., air) stream which attenuates the filaments of molten thermoplastic material to reduce their diameter. Thereafter, the meltblown fibers are carried by the high velocity gas stream and are deposited on a collecting surface to form a web of randomly dispersed meltblown fibers. Meltblown fibers include both microfibers (fibers having a diameter, e.g., of less than about 10 microns) and macrofibers (fibers having a diameter, e.g., of about 20–100 microns; most macrofibers have diameters of 20–50 microns). Whether microfibers or macrofibers are formed depend, e.g., on the extrusion die size and, particularly, the degree of attenuation of the extruded polymer material. Meltblown macrofibers, as compared to meltblown microfibers, are firmer, and provide a product having a higher bulk. Generally, meltblown elastic fibers have relatively large diameters, and do not fall within the microfiber size range. A process for forming meltblown fibers is disclosed, for example, in U.S. Pat. No. 3,849,241 to Buntin et al and U.S. Pat. No. 4,048,364 to Harding et al, the contents of each of which are herein incorporated by reference.

Various known elastomeric materials can be utilized for forming the meltblown elastomeric fibers; some are disclosed in U.S. Patent No. 4,657,802 to Morman, the contents of which are incorporated herein by reference. Briefly, this patent discloses various elastomeric materials for use in formation of, e.g., nonwoven elastomeric webs of meltblown fibers, including polyester elastomeric materials, polyurethane elastomeric materials, polyetherester elastomeric materials and polyamide elastomeric materials. Other elastomeric materials for use in the formation of the fibrous nonwoven elastic web include (a) A-B-A′ block copolymers, where A and A′ are each a thermoplastic polymer end block which includes a styrenic moiety and where A may be the same thermoplastic polymer end block as A′, such as a poly(vinyl arene), and where B is an elastomeric polymer mid block such as a conjugated diene or a lower alkene; or (b) blends of one or more polyolefins or poly-(alpha-methylstyrene) with A-B-A′ block copolymers, where A and A′ are each a thermoplastic polymer end block which includes a styrenic moiety, where A may be the same thermoplastic polymer end block as A′, such as a poly(vinyl arene) and where B is an elastomeric polymer mid block such as a conjugated diene or a lower alkene. Various specific materials for forming the meltblown elastomeric fibers include polyester elastomeric materials available under the trade designation "Hytrel" from E. I. DuPont De Nemours & Co., polyurethane elastomeric materials available under the trade designation "Estane" from B. F. Goodrich & Co., polyetherester elastomeric materials available under the trade designation "Arnitel" from A. Schulman, Inc. or Akzo Plastics, and polyamide elastomeric materials available under the trade designation "Pebax" from the Rilsan Company. Various elastomeric A-B-A′ block copolymer materials are disclosed in U.S. Pat. Nos. 4,323,534 to Des Marais and 4,355,425 to Jones, and are available as "Kraton" polymers from the Shell Chemical Company.

When utilizing various of the "Kraton" materials (e.g., "Kraton" G), it is preferred to blend a polyolefin therewith, in order to improve meltblowing of such block copolymers; a particularly preferred polyolefin for blending with the "Kraton" G block copolymers is polyethylene, a preferred polyethylene being Petrothene Na601 obtained from U.S.I. Chemicals Company. Discussion of various "Kraton" blends for meltblowing purposes are described in U.S. Patent No. 4,657,802, previously incorporated by reference, and reference is directed thereto for purposes of such "Kraton" blends.

It is preferred that conventional meltblowing techniques be modified, as set forth below, in providing the most advantageous elastic meltblown webs to be hydraulically entangled. As indicated previously, fiber mobility is highly important to the hydraulic entangling process. For example, not only do the "wrapper" fibers have to be flexible and mobile, but in many instances the base fibers (around which the other fibers are wrapped) also need to move freely. However, an inherent property of elastic meltblowns is agglomeration of the fibers; that is, the fibers tend to stick together or bundle as a result of their tackiness. Accordingly, it is preferred, in forming the meltblown web, to take steps to limit the fiber-to-fiber bonding of the meltblown web. Techniques for reducing the degree of fiber-to-fiber bonding include increasing the forming distance (the distance between the die and the collecting surface), reducing the primary air pressure or temperature, reducing the forming (under wire) vacuum and introducing a rapid quench agent such as water to the stream of meltblown fibers between the die and collecting surface (such introduction of a rapid quench agent is described in U.S. Pat. No. 3,959,421 to Weber, et al., the contents of which is incorporated herein by reference). A combination of these techniques allows formation of the most advantageous meltblown web for hydraulic entangling, with sufficient fiber mobility and reduced fiber bundle size.

A specific example will now be described, using "Arnitel", a polyetherester elastomeric material available from A. Schulman, Inc. or Akzo Plastics, as the elastomeric material formed into meltblown webs to be hydraulically entangled. Thus, conventional parameters for forming meltblown "Arnitel" webs, to provide meltblown "Arnitel" webs to be hydraulically entangled, were changed as follows: (1) the primary air temperature was reduced; (2) the forming distance was increased; (3) the forming vacuum was reduced; and (4) a water quench system was added. Moreover, a forming drum, rather than a flat forming wire, was used for fiber collection, with the fibers being collected at a point tangential to the drum surface.

Essentially, the above-cited changes resulted in rapid fiber quench ing thereby reducing the degree of fiber-to-fiber bonding and the size of fiber bundles. The velocity of the fiber stream, as it was collected in web form, was reduced along with impact pressure resulting in the formation of a loosely packed non-agglomerated fiber assembly, which could advantageously be hydraulically entangled.

Various known pulp fibers, such as wood pulp fibers, can be layered with the meltblown elastic fibers in forming elastic webs having cloth-like properties. For example, Harmac Western red cedar/hemlock paper can be laminated to a meltblown elastic web and the laminate subjected to hydraulic entanglement. Various other known pulp fibers, both wood pulp and other natural and synthetic pulp fibers, can be utilized. As a specific example, cotton linter fibers can be utilized; the product formed is stretchable, is highly absorbent, and is inexpensive and can be used for disposable applications such as wipes.

In addition, staple fibers can also be used to provide cloth-like properties to meltblown elastic webs. For example, a web of carded polyester staple fiber can be layered with a meltblown elastic web and the laminate then hydraulically entangled, so as to provide cloth-like properties.

As can be appreciated, where the, e.g., staple fiber web is positioned on only one side of the meltblown elastic web, the tactile feeling of the final product is "two-sided", with one side having the plastic (rubbery)-like feel of the meltblown elastic web. Of course, by providing a sandwich structure having a meltblown elastic web sandwiched between polyester staple fiber webs, with the sandwich being subjected to hydraulic entanglement (e.g., from both opposed sides of the laminate), such "two-sided"product can be avoided.

By adding additional layers (e.g., webs) to the laminate prior to hydraulic entanglement, and then entangling the entire laminate, various desired properties, including barrier properties, can be added to the web materials. For example, by adding an additional web of meltblown polypropylene fibers to the meltblown elastic web, with, e.g., layers of wood pulp fibers sandwiching the meltblown elastic web/meltblown polypropylene web combination, after hydraulic entanglement the final product has improved barrier properties against passage of liquids and/or particulates, while still providing a cloth-like feel. These materials, with improved barrier properties, may readily be applicable as cheap disposable outer covers, absorbents, cleaning mop covers, bibs, protective clothing, filters, etc.

Continuous filaments (e.g., a spunbond web) can also be used for the layer laminated with the meltblown fiber layer. As can be appreciated, where the continuous filaments are formed of an elastomeric material (e.g., spandex) the formed composite will have elastic properties. If the layer of continuous filaments is made of a nonelastic but elongatable material, elasticity of the formed composite can be achieved by mechanically working (stretching) the composite after hydraulic entanglement, corresponding to the technique discussed in U.S. Pat. No. 4,209,563 to Sisson, the contents of which are incorporated herein by reference.

As indicated previously, in forming the product of the present invention various composites, such as coforms, can be used. By a coform, for the present invention, we mean an admixture (e.g., codeposited admixture) of meltblown fibers and fibrous material (e.g., at least one of pulp fibers, staple fibers, additional meltblown fibers, continuous filaments, and particulates). Desirably, in such coform the fibrous material, and/ or particulate material, is intermingled with the meltblown fibers just after extruding the material of the meltblown fibers through the meltblowing die, as discussed in U.S. Pat. No. 4,100,324 to Anderson et al, the contents of which are incorporated herein by reference.

As a specific aspect of the present invention, synthetic pulp fibers, of a material such as polyester or polypropylene, as the layer laminated with the meltblown elastomeric web, can conceivably be used to provide a product, after hydraulic entanglement of the laminate, that can be used for filters, wipes (especially wipes for wiping oil), etc. More particularly, by using the meltblown elastic web, in combination with a layer of synthetic pulp fibers that are at most 0.25 inches in length and 1.3 denier, a final product might be provided that not only has stretch properties, but also is a very well integrated final product with more drape and a softer hand than that achieved with the use of, e.g., short synthetic fibers of at least 0.5 inches. Moreover, in order to further secure the short fibers and elastic meltblown fibers together, a binder can be applied to the hydraulically entangled product, to further bond the fibers.

Elastomeric materials such as polyurethane, polyetheresters, etc. are solvent and high-temperature stable, and thus can withstand laundering requirements of a durable fabric. The same is true for polyester staple fibers. These materials are particularly appropriate in forming durable fabrics.

FIG. 1 schematically shows an apparatus for producing a hydraulically entangled nonwoven fibrous elastomeric web of the present invention. In such FIG. 1, that aspect of the present invention, wherein a laminate comprised of layers of a coform and of a meltblown elastomeric web is provided and hydraulically entangled, is shown, with such laminate being formed continuously and then passed to the hydraulic entangling apparatus.

Of course, the layers can be formed individually and stored, then later formed into a laminate and passed to hydraulic entangling apparatus. Also, two coform layers can be used, the coform layers sandwiching the meltblown elastomeric web. In such embodiment, the laminate of coform/meltblown elastomeric/coform is formed with apparatus having coform-producing devices in line with the meltblown elastomeric-producing device, the coform-producing devices being located respectively before and after the meltblown elastomeric-producing device.

A gas stream 2 of meltblown elastic fibers is formed by known meltblowing techniques on conventional meltblowing apparatus generally designated by reference numeral 4, e.g., as discussed in the previously referred to U.S. Pat. Nos. 3,849,241 to Buntin et al and 4,048,364 to Harding et al. Basically, the method of formation involves extruding a molten polymeric material through a die head generally designated by the reference numeral 6 into fine streams and attenuating the streams by converging flows of high velocity, heated gas (usually air) supplied from nozzles 8 and 10 to break the polymer streams into meltblown fibers. The die head preferably includes at least one straight row of extrusion apertures. The meltblown fibers are collected on, e.g., forming belt 12 to form meltblown elastic fiber layer 14.

The meltblown elastic fiber layer 14 can be laminated with a layer of coform material (e.g., a coform web material). As shown in FIG. 1, the latter layer can be formed directly on the meltblown layer 14. Specifically, to form the coform, a primary gas stream of meltblown fibers is formed as discussed above, with structure corresponding to the structure utilized for forming the previously described meltblown elastic fibers; accordingly, structure, of the meltblowing apparatus for forming the meltblown fibers of the coform, that corresponds to the same structure for forming the meltblown elastic fiber layer, has been given corresponding reference numbers but are "primed". The primary gas stream 11 is merged with a secondary gas stream 38 containing fibrous material (pulp fibers and/or staple fibers and/or further meltblown fibers and/or continuous filaments), with or without particulate material, or containing just the particulate material. Again, reference is made to such U.S. Pat. No. 4,100,324 to Anderson et al for various materials which can be utilized in forming the coform. In FIG. 1, the secondary gas stream 38 is produced by a conventional picker roll 30 having picking teeth for divellicating pulp sheets 24 into individual fibers. The pulp sheets 24 are fed radially, i.e., along a picker roll radius, to the picker roll 30 by means of rolls 26. As the teeth on the picker roll 30 divellicate the pulp sheets 24 into individual fibers, the resulting separated fibers are conveyed downwardly toward the primary air stream 11 through a forming nozzle or duct 20. A housing 28 encloses the roll 30 and provides passage 42 between the housing 28 and the picker roll surface. Process air is supplied by conventional means, e.g., a blower, to the picker roll 30 in the passage 42 via duct 40 in sufficient quantity to serve as a medium for conveying fibers through the duct 40 at a velocity approaching that of the picker teeth.

As seen in FIG. 1, the primary and secondary streams 11 and 38 are moving perpendicular to each other, the velocity of the secondary stream 38 being lower than that of the primary stream 11 so that the integrated stream 36 flows in the same direction as primary stream 11. The integrated stream is collected on the meltblown layer 14, to form laminate 44.

Thereafter, the laminate 44 is hydraulically entangled, the web remaining basically two-sided, but with a sufficient amount of interentangling and intertwining of the fibers so as to provide a final product that is sufficiently mechanically interentangled so that the fibers do not separate.

It is not necessary that, in the laminate, the webs themselves, or layers thereof (e.g., the meltblown fibers and/or pulp or staple fibers), be totally unbonded when passed into the hydraulic entangling step. The main criterion is that, during hydraulic entangling, there are sufficient free fibers (that is, the fibers are sufficiently mobile) to provide the desired degree of entanglement Thus, such sufficient mobility can possibly be provided by the force of the jets during the hydraulic entangling, if, e.g., the meltblown fibers have not been agglomerated too much in the meltblowing process. Various techniques for avoiding disadvantageous agglomeration of the meltblown fibers, in the context of meltblown elastomeric fibers, have been previously discussed.

Alternatively, the laminate can be treated prior to the hydraulic entangling to sufficiently unbond the fibers. For example, the laminate can be, e.g., mechanically stretched and worked (manipulated), e.g., by using grooved nips or protuberances, prior to hydraulic entangling to sufficiently unbond the fibers.

The hydraulic entangling technique involves treatment of the laminate or web 44, while supported on an apertured support 48, with streams of liquid from jet devices 50. The support 48 can be a mesh screen or forming wires or an apertured plate. The support 48 can also have a pattern so as to form a nonwoven material with such pattern, or can be provided such that the hydraulically entangled web is non-patterned. The apparatus for hydraulic entanglement can be conventional apparatus, such as described in U.S. Pat. No. 3,485,706 to Evans, the contents of which are incorporated herein by reference. In such an apparatus, fiber entanglement is accomplished by jetting liquid (e.g., water) supplied at pressures, for example, of at least about 200 psi (gauge), to form fine, essentially columnar, liquid streams toward the surface of the supported laminate. The supported laminate is traversed with the streams until the fibers are randomly entangled and intertwined. The laminate can be passed through the hydraulic entangling apparatus a number of times on one or both sides, with the liquid being supplied at pressures of from about 100 to 3000 psi (gauge). The orifices which produce the columnar liquid streams can have typical diameters known in the art, e.g., 0.005 inches, and can be arranged in one or more rows with any number of orifices, e.g., 40 in each row. Various techniques for hydraulic entangling are described in the aforementioned U.S. Pat. No. 3,485,706, and this patent can be referred to in connection with such techniques. Alternatively, apparatus for the hydraulic entanglement is described by Honeycomb Systems, Inc., Biddeford, Maine, in the article entitled "Rotary Hydraulic Entanglement of Nonwovens", reprinted from *INSIGHT '86 INTERNATIONAL ADVANCED FORMING/BONDING Conference,* the contents of which are incorporated herein by reference.

After the laminate has been hydraulically entangled, it may, optionally, be treated at a bonding station (not shown in FIG. 1) to further enhance its strength. Such a bonding station is disclosed in U.S. Pat. No. 4,612,226 to Kennette, et al., the contents of which are incorporated herein by reference. Other optional secondary bonding treatments include thermal bonding, ultrasonic bonding, adhesive bonding, etc. Such secondary bonding treatments provide added strength, but also stiffen the resulting product (that is, provide a product having decreased softness).

After the laminate has been hydraulically entangled or further bonded, it can be dried by drying cans 52 (or other drying means, such as an air through dryer, known in the art), and wound on winder 54.

The composite product formed, e.g., after hydraulic entangling or further bonding, or after drying, can be further laminated to, e.g., a film, so as to provide further desired characteristics to the final product. For example, the composite can be further laminated to an extruded film, or have a coating (e.g., an extruded coating) formed thereon, so as to provide a final product having specific desired properties. Such further lamination of, e.g., a film or extruded coating, can be used to provide work wear apparel with desired properties.

In the following, various specific embodiments of the present invention are described, for purposes of illustrating, not limiting, the present invention.

A Harmac Western red cedar/hemlock paper (basis weight of 0.8 oz/yd.$^2$) was placed on top of a meltblown elastic web of a polymer blend of 70% "Kraton" G 1657 and 30% polyethylene wax (hereinafter designated as Q70/30), the web having a basis weight of 2.5 oz./yd.$^2$; such laminate of the paper and meltblown elastic web was passed under hydraulic entangling apparatus three times. Such hydraulic entangling apparatus included a manifold having 0.005 inch diameter orifices, with 40 orifices per inch and with one row of orifices, the pressure of the liquid issuing from such orifices being set at 400 psi (gauge). The laminate was supported on a support of 100×92 semi-twill mesh. After being oven dried and hand softened, a textured cloth-like fabric was produced. The fabric had a measured 60% machine direction stretch, 70% cross direction stretch and at least 98% recovery in both directions. With the paper on only one side, the tactile feeling of the entangled product was "two-sided"; to eliminate such "two-sidedness", after the previously described hydraulic entanglement the substrate was turned over, another 0.8 oz./yd$^2$ paper sheet was placed on top and again similarly processed by hydraulic entangling and oven-drying and hand softening. With this, the web no longer felt two-sided; and stretch and recovery were similar as previously mentioned. Resistance of the wood fibers coming loose from the web when wetted and mechanically worked (washed) was excellent.

Figure 2A:
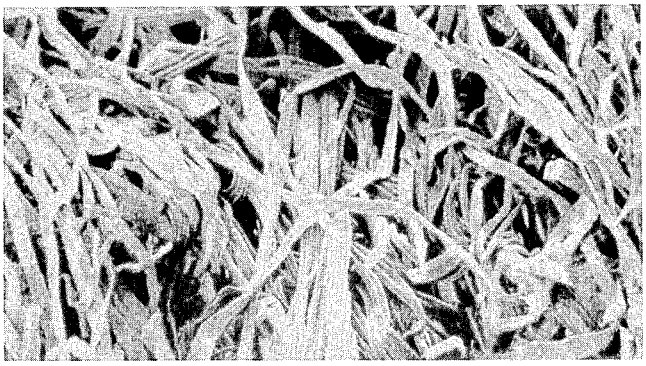
FIGS. 2A and 2B are photomicrographs, (78× and 77× magnification, respectively), of respective opposed sides of the web material formed by subjecting a two-layer laminate to hydraulic entanglement according to the present invention.
Figure 2B:
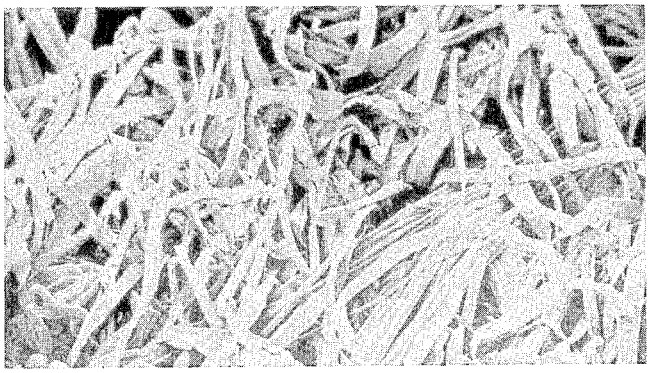

FIGS. 2A and 2B show a hydraulically entangled product formed from a laminate of a wood fiber layer and a meltblown elastic fiber layer, the wood fiber layer being red cedar (34 gsm) and the meltblown elastic fiber layer being a Q 70/30 blend (that is, a blend of 70% "Kraton" G 1657/30% polyethylene wax) having a basis weight of 85 gsm. In FIG. 2A, the wood fiber side faces up, while in FIG. 2B the meltblown elastic side faces up.

Furthermore, corrugated stretchable fabrics can be produced utilizing the same technique previously discussed, but by pre-stretching the elastic web 25% on a frame before the hydraulic entangling.

Figure 3A:
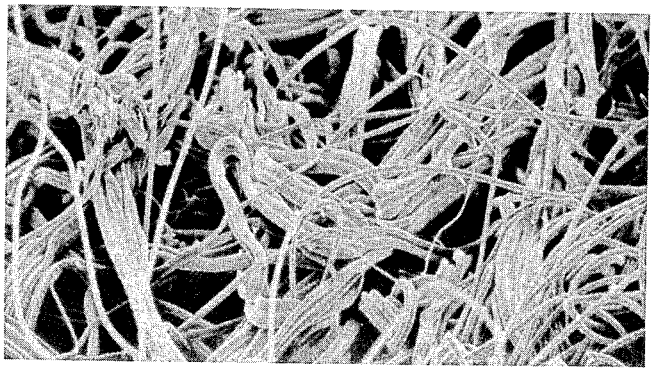
FIGS. 3A and 3B are photomicrographs, (73× and 65× magnification, respectively), of respective opposed sides of another example of a product formed by hydraulic entangling a three-layer laminate according to the present invention.
Figure 3B:
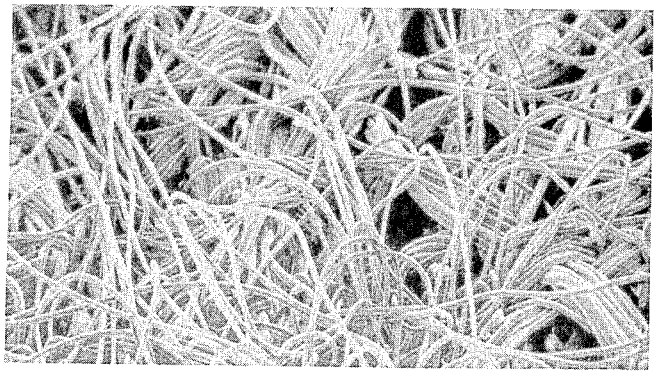
Figure 3C:
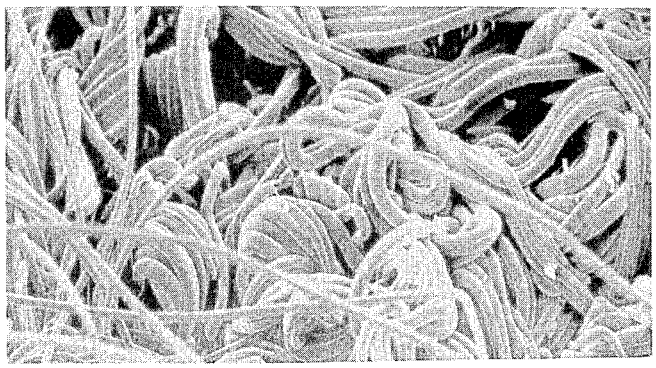
FIG. 3C shows the same side of the same product as FIG. 3B, but at a higher magnification, (110× magnification).

Next will be described the use of staple fibers to make meltblown elastic webs to be cloth-like. Thus, a meltblown elastic web of Q 70/30 blend (that is, a blend of 70% "Kraton" G 1657/30% polyethylene wax), having a basis weight of 2.5 oz./yd$^2$, was sandwiched between carded polyester staple fiber (1.5 d.p.f.$\times\frac{3}{4}$") webs (each having a weight of 0.26 oz./yd$^2$), thereby forming the laminate to be hydraulically entangled. The staple webs were cross-lapped in order to produce fairly isotropic fiber orientation. The laminate was placed on a 100×92 mesh as support, and passed under hydraulic entangling equipment six times on each side. The manifold pressure was adjusted to 200 p.s.i.g. for the first pass followed by 400, 800, 1200, 1200 and 1200 p.s.i.g., respectively. The fabric, shown in FIGS. 3A, 3B and 3C, had good hand and drape with an isotropic stretch of 25% and recovery of at least 75%. The hydraulic entanglement could also be performed with the meltblown elastic web being pre-stretched, with results as discussed previously. Moreover, the elastic and strength properties could be readily varied by adjusting the amount of staple and elastic fiber, fiber types and orientation in the web.

The following describes that aspect of the present invention wherein barrier properties can be provided for web materials including meltblown elastic webs. Thus, a composite meltblown elastic web (basis weight of 2.8 oz./yd$^2$) was initially made. Such composite web was a partial blend of a meltblown elastic web of Q 70/30 (basis weight of 2.5 oz./yd$^2$) and a meltblown polypropylene web (basis weight of 0.3 oz./yd$^2$). The composite was formed by utilizing dual meltblowing die tips positioned so that a small amount of intermixing occurred above the forming wire between fibers of the Q 70/30 blend and polypropylene extruded fibers. With this partial fiber commingling, any potential delamination problem between the two fiber types was avoided. A Harmac Western red cedar/hemlock paper (basis weight of 1.0 oz./yd$^2$) was added to the side of the meltblown composite that was primarily of the Q 70/30 blend, and then the entire structure was subjected to hydraulic entanglement, thereby entangle bonding the fibers. Thereafter, a Harmac Western red cedar/hemlock paper (basis weight 1.0 oz./yd$^2$) was added to the other side of the meltblown composite, and the other side was subjected to entangle-bonding using hydraulic entanglement. With this, barrier properties, strength, and resistance of the paper fibers washing out were improved; however, because of the incorporation of the inelastic polypropylene, stretch was significantly reduced to 12% in the machine direction and 18% in the cross direction. Recovery was greater than 98%. For increased barrier properties, post-calendering of the fabric could be performed; moreover, for higher stretch, notwithstanding use of the meltblown non-elastic fibers, the nonelastic web could be individually formed and pre-corrugated on a forming wire. In any event, and as can be seen in this aspect of the present invention, various properties of the basic meltblown elastic webs can be modified utilizing additional webs and/or fibers, and utilizing hydraulic entanglement to entangle bond the meltblown elastic web and such other webs and/or fibers.

As an additional aspect of the present invention, a durable, drapable elastomeric web material, can be obtained by hydraulically entangling a laminate having a layer of a meltblown elastic web and synthetic pulp fibers, such as polyester pulp. More particularly, a nonwoven elastic web material that can be used for, e.g., filters and wipes can be achieved by utilizing synthetic pulp fibers having a length of at most 0.25 inches and being at most 1.3 denier. The meltblown elastomeric web is initially formed, e.g., by conventional techniques, and then the polyester pulp is layered thereon by any one of a number of techniques, such as (1) wet-forming directly from a head box; (2) applying a preformed wet laid sheet; or (3) air-laying a web. The layered laminate is then hydraulically entangled at operating pressures up to 2000 psi, so as to entangle bond the meltblown elastic web and the pulp fibers. The structure produced is a two-component composite, and desirably the final basis weight of such material is 100–200 g/m$^2$. Desirably, the percentage of polyester pulp fiber will vary from 15–65% of the total final basis weight of the web material.

Various specific examples of the present invention, showing properties of the formed product, are set forth in the following. Of course, such examples are illustrative and are not limiting.

In the following examples, the specified materials were hydraulically entangled under the described conditions. The hydraulic entangling was carried out using hydraulic entangling equipment similar to conventional equipment, having Honeycomb (Biddeford, Maine) manifolds with 0.005 inch orifices and 40 orifices per inch, and with one row of orifices. In each of the layers in the examples including a blend of fibers, the percentages recited are weight percents.

EXAMPLE 1

Laminate Materials: Polypropylene staple fiber web (approx. 20 g/m$^2$)/meltblown elastic web of "Arnitel" (approx. 80 gsm)/polypropylene staple fiber web (approx. 20 g/m$^2$)

Entangling Processing Line Speed: 23 fpm

Entanglement Treatment (psi of each pass); (wire mesh employed for the supporting member):

Side One: 800, 1000, 1400; 20×20

Side Two: 1200, 1200, 1200; 100×92

EXAMPLE 2

Laminate Materials: blend of 50% polyethylene terephthalate and 50% rayon staple fibers (approx. 20 g/m$^2$)/meltblown elastic web of "Arnitel" (approx. 65 g/m$^2$)/blend of 50% polyethylene terephthalate and 50% rayon staple fibers (approx. 20 g/m$^2$)

Entangling Processing Line Speed: 23 fpm

Entanglement Treatment (psi of each pass); (wire mesh):

Side One: 1400, 1400, 1400; 20×20

Side Two: 1000, 1000, 1000; 100×92

EXAMPLE 3

Laminate Materials: polypropylene staple fibers (approx. 15 g/m$^2$)/meltblown elastic web of Q 70/30

(approx. 85 g/m²)/polypropylene staple fibers (approx. 15 g/m²)
Entangling Processing Line Speed: 50 fpm
Entanglment Treatment (psi of each pass); (wire mesh):
Side One: 150, 200, 300, 400, 600, 600; 20×20
Side Two: 150, 200, 300; 400, 600, 600; 100×92

EXAMPLE 4

Laminate Materials: polyethylene terephthalate staple fibers (approx. 25 g/m²)/meltblown elastic web of "Arnitel" (approx. 75 g/m²)/polyethylene terephthalate staple fibers (approx. 25 g/m²)
Entangling Processing Line Speed: 50 fpm
Entanglement Treatment (psi of each pass); (wire mesh):
Side One: 1500, 1500, 1500; 20×20
Side Two: 1500, 1500, 1500; 20×20
Side One (again): 200, 400, 800, 1200, 1200, 1200; 100×92
Side Two (again): 200, 400, 800, 1200, 1200, 1200; 100×92

The meltblown "Arnitel" elastomeric fiber web was pre-treated by supporting the web on a 20×20 mesh and subjecting the supported web by itself to hydraulic entanglement, prior to the lamination and hydraulic entanglement. The pre-treatment makes bundles of the elastomeric fiber and allows areas where there are holes or a low density of meltblown elastomer, which thereby improves hydraulic entanglement of the laminate and elasticity of the final product. Additionally, the pre-treatment may reduce the over-all dimensions of the elastomeric fiber web which imparts greater elasticity to the resultant laminate

EXAMPLE 5

Laminate Materials: polyethylene terephthalate staple fibers (approx 20 g/m²)/meltblown elastic web of "Arnitel" (approx. 65 g/m²)/polyethylene terephthalate staple fibers (approx. 20 g/m²)
Entangling Processing Line Speed: 23 fpm
Entanglement Treatment (psi of each pass); (wire mesh):
Side One: 200, 400, 800, 1200, 1200, 1200; 100×92
Side Two: 200, 400, 800, 1200, 1200, 1200; 100×92
The meltblown "Arnitel" web was pre-treated (see Example 4).

EXAMPLE 6

Laminate Materials: polypropylene staple fibers (approx. 20 g/m²)/meltblown Q 70/30 (approx. 85 g/m²)/polypropylene staple fibers (approx 20 g/m²)
Entangling Processing Line Speed: 23 fpm
Entanglement Treatment (psi of each pass); (wire mesh):
Side One: 1000, 1300, 1500; 20×20
Side Two: 1300, 1500, 1500; 100×92

EXAMPLE 7

Laminate Materials: polyethylene terephthalate staple fibers (approx. 20 g/m²)/meltblown elastic web of "Arnitel" (approx. 80 g/m²)/polyethylene terephthalate staple fibers (approx. 20 g/m²)
Entangling Processing Line Speed: 23 fpm
Entanglement Treatment (psi of each pass); (wire mesh):
Side One: 1400, 1400, 1400; 20×20
Side Two: 800, 800, 800; 100×92

EXAMPLE 8

Laminate Materials: coform of 50% cotton and 50% meltblown polypropylene (approx. 50 g/m²)/meltblown elastic web of "Arnitel"(approx. 60 g/m²)/coform of 50% cotton and 50% meltblown polypropylene (approx. 50 g/m²)
Entangling Processing Line Speed 23 fpm
Entanglement Treatment (psi of each pass); (wire mesh):
Side One: 800, 1200, 1500; 20×20
Side Two: 1500, 1500, 1500; 20×20

EXAMPLE 9

Laminate Materials: coform of 50% cotton and 50% meltblown polypropylene (approx. 50 g/m²)/meltblown elastic web of "Arnitel" (approx. 65 g/m²)/coform of 50% cotton and 50% meltblown polypropylene (approx. 50 g/m²)
Entangling Processing Line Speed 23 fpm
Entanglement Treatment (psi of each pass); (wire mesh):
Side One: 1600, 1600, 1600; 20×20
Side Two: 1600, 1600, 1600; 20×20
The meltblown "Arnitel" was pre-treated (see Example 4).

EXAMPLE 10

Laminate Materials: Harmac red cedar paper (approx. 27 g/m²)/meltblown Q 70-30 (approx. 85 g/m²)/Harmac red cedar paper (approx. 27 g/m²)
Entangling Processing Line Speed 23 fpm
Entanglement Treatment (psi of each pass); (wire mesh):
Side One: 400, 400, 400; 100×92
Side Two: 400, 400, 400; 100×92
Side One (again): 400, 400, 400; 20×20

Physical properties of the materials of Examples 1-10 were measured in the following manner:

The bulk was measured using a bulk or thickness tester available in the art. The bulk was measured to the nearest 0.001 inch.

The MD and CD grab tensiles were measured in accordance with Federal Test Method Standard No. 191A (Methods 5041 and 5100, respectively).

The abrasion resistance was measured by the rotary platform, double-head (Tabor) method in accordance with Federal Test Method Standard No. 191A (Method 5306). Two type CS10 wheels (rubber based and of medium coarseness) were used and loaded with 500 grams. This test measured the number of cycles required to wear a hole in each material. The specimen is subjected to rotary rubbing action under controlled conditions of pressure and abrasive action.

A "cup crush" test was conducted to determine the softness, i.e., hand and drape, of each of the samples. The lower the peak load of a sample in this test, the softer, or more flexible, the sample. Values of 100 to 150 grams, or lower, correspond to what is considered a "soft"material.

The elongation and recovery tests were conducted as follows. Three inch wide by four inch long samples were stretched in four inch Instrom jaws to the elongation length, described as % Elongation. For example, a four inch length stretched to a 5⅝" length would be elongated 40.6%. The initial load (lbs.) was recorded, then after 3 minutes was recorded before relaxing the sample. Thereafter, the length was measured, and initial percent recovery determined. This is recorded as initial percent recovery. For example, if a material was stretched to 4½" (12.5% Elongation) and then after relaxation measured 4-1/16", the sample recovery was 87.5%. After thirty (30) minutes, the length was again measured and a determination made (and recorded) as percent recovery after thirty (30) minutes. This elongation test is not a measure of the elastic limit, the elongation being chosen within the elastic limit.

The results of these tests are shown in Table 1. In this Table, for comparative purposes are set forth physical properties of two known hydraulically entangled nonwoven fibrous materials, "Sontara" 8005, a spunlaced fabric of 100% polyethylene terephthalate staple fibers (1.35 d.p.f.×¾") from E. I. DuPont De Nemours and Company, and "Optima", a converted product of 55% Western red cedar/hemlock pulp fibers and 45% polyethylene terephthalate staple fibers from American Hospital Supply Corp.

TABLE 1

| | | | MD Grab Tensiles | | | | |
|---|---|---|---|---|---|---|---|
| Example | Basis Wt. (gsm) | Bulk (in) | Peak Energy (in-lb) | Peak Load (lb) | Peak Elongation (in) | Peak Strain (%) | Fail Energy (in-lb) |
| 1 | 102 | .038 | 41.1 | 12.2 | 5.8 | 191.9 | 85.5 |
| 2 | 111 | .030 | 35.2 | 9.5 | 5.3 | 176.1 | 44.9 |
| 3 | 112 | .047 | 20.0 | 2.9 | 8.6 | 287.2 | 22.2 |
| 4 | 156 | .044 | 56.0 | 26.2 | 4.9 | 164.9 | 97.2 |
| 5 | 129 | .042 | 47.3 | 18.7 | 4.4 | 147.6 | 107.8 |
| 6 | 102 | .035 | 3.6 | 6.9 | 1.0 | 32.4 | 19.9 |
| 7 | 102 | .038 | 37.5 | 11.5 | 6.1 | 202.0 | 62.6 |
| 8 | 158 | .045 | 17.5 | 32.1 | 1.7 | 55.1 | 57.2 |
| 9 | 196 | .049 | 19.4 | 8.6 | 6.2 | 205.9 | 36.8 |
| 10 | 129 | .045 | 12.8 | 4.0 | 4.4 | 145.6 | 22.1 |
| Sontara ® 8005 | 65 | .020 | 20.1 | 42.3 | 1.0 | 34.6 | 40.4 |
| Optima ® | 72 | .020 | 12.9 | 26.3 | 1.0 | 33.8 | 35.1 |

| | CD Grab Tensiles | | | | | Tabor Abrasion Resistance (no. of cycles) | |
|---|---|---|---|---|---|---|---|
| Example | Peak Energy (in-lb) | Peak Load (lb) | Peak Elongation (in) | Peak Strain (%) | Fail Energy (in-lb) | Side 1 | Side 2 |
| 1 | 52.9 | 11.4 | 9.9 | 329.4 | 76.8 | 100+ | 100+ |
| 2 | 44.0 | 8.2 | 9.1 | 304.2 | 59.4 | 100+ | 100+ |
| 3 | 26.1 | 2.6 | 14.0 | 467.7 | 26.3 | 100+ | 100+ |
| 4 | 51.3 | 15.2 | 5.3 | 176.3 | 84.6 | 100+ | 100+ |
| 5 | 40.1 | 12.4 | 6.6 | 218.7 | 51.6 | 100+ | 100+ |
| 6 | 15.4 | 2.6 | 9.2 | 307.2 | 18.5 | 100+ | 100+ |
| 7 | 41.2 | 7.2 | 10.5 | 349.9 | 59.8 | 100+ | 100+ |
| 8 | 9.9 | 11.3 | 2.0 | 65.2 | 26.5 | 100+ | 100+ |
| 9 | 22.0 | 8.5 | 6.0 | 200.6 | 35.6 | 100+ | 100+ |
| 10 | 15.0 | 3.4 | 6.4 | 2.3 | 29.4 | 100+ | 100+ |
| Sontara ® 8005 | 23.0 | 18 | 4.0 | 134.3 | 39.8 | 28 | 20 |
| Optima ® | 16.6 | 22 | 2.1 | 71.0 | 32.0 | 93 | 24 |

| | MD Elongation and Recovery | | | | |
|---|---|---|---|---|---|
| Example | Elongation (%) | Initial Load (lbs) | 3 min. Load (lbs) | Initial Recovery Percent | Percent Recovery 30 mins. |
| 1 | 19 | 3.7 | 2.2 | 95 | 99 |
| 2 | 14 | 8.4 | 5.9 | 97 | 99 |
| 3 | 38 | — | — | — | 96 |
| 4 | 25 | 5.3 | 4.0 | 94 | 94 |
| 5 | 19 | 2.7 | 2.1 | 95 | 95 |
| 6 | 13 | 6.7 | 2.1 | 94 | 95 |
| 7 | 28 | 4.3 | 2.8 | 89 | 90 |
| 8 | 13 | 6.7 | 4.4 | 96 | 99 |
| 9 | 22 | — | — | — | 71 |
| 10 | 44 | — | — | 93 | — |

| | CD Elongation and Recovery | | | | | Cup Crush (softness) | |
|---|---|---|---|---|---|---|---|
| Example | Elongation (%) | Initial Load (lbs) | 3 min. Load (lbs) | Initial Recovery Percent | Percent Recovery 30 mins. | Peak Load (grams) | Total Energy (grams/mm) |
| 1 | 34 | 1.1 | .8 | 91 | 91 | | |
| 2 | 20 | 3.7 | 2.7 | 94 | 95 | 116 | 1765 |
| 3 | 44 | — | — | — | 93 | 85 | 1374 |
| 4 | 25 | 3.8 | 2.7 | 89 | 89 | 288 | 4809 |
| 5 | 38 | 1.7 | 1.3 | 87 | 88 | 119 | 2174 |
| 6 | 50 | 1.0 | 0.5 | 87 | 94 | | |
| 7 | 28 | 0.9 | 0.7 | 94 | 94 | 110 | 1558 |
| 8 | 16 | 4.3 | 2.9 | 94 | 95 | — | — |
| 9 | 31 | — | — | — | 90 | 147 | 2412 |
| 10 | 69 | — | — | 90 | — | 212 | 3076 |
| Sontara ® 8005 | | | | | | 89 | 1537 |
| Optima ® | | | | | | 196 | 3522 |

As seen in the foregoing Table 1, nonwoven fibrous elastic web materials within the scope of the present invention have a superior combination of, e.g., strength and elasticity/recovery, while having superior softness and other cloth-like properties. The improved abrasion-resistance of the hydraulically entangled meltblown elastic web according to the present invention is in part due to the higher coefficient of friction of the elastic material. The superior elasticity/recovery properties of the present invention can be achieved without heat-shrinking or any other post-bonding treatment, and without any plastic (rubbery) feel.

The elasticity of the product of the present invention can be increased by entangling the meltblown elastic web prior to laminating with the further layer and hydraulically entangling. Thus, the elasticity of the product according to the present invention can be advantageously controlled.

Moreover, the nonwoven fibrous elastic web materials of the present invention can have elastic and strength properties that are approximately the same in both machine- and cross-directions. In addition, they can also be formed to primarily have either machine-direction elasticity or cross-direction elasticity.

The meltblown elastic web product of the present invention can have a smooth surface, and need not be puckered as in the stretch-bonded-laminates disclosed in U.S. Pat. No. 4,657,802 to Morman. Of course, as disclosed previously, the web product of the present invention can be provided with a puckered surface. Moreover, the web product of the present invention can have a "fuzzy" surface (due to hydraulic entanglement of a laminate), thereby hiding the plastic (rubbery)-like feel of the meltblown elastic web. The web material, after hydraulic entangling, can be subjected to a stretching treatment to raise fibers of the outer layers of the laminate and give an extra "fuzzy" feel (that is, provide increased hand). Clearly, the present invention increases the choice for the hand and texture of the hydraulically entangled elastic product, while retaining elasticity.

The hydraulically entangled product of the present invention, having the meltblown elastic web as the central layer, has increased drape without sacrificing the feel of the product. Moreover, the product of the present invention, particularly where the fibrous material is of pulp fibers, staple fibers or meltblown fibers, need not have a positive stop; note that the stretch-bonded-laminates have such positive stop (the limit of extensibility of the nonelastic layers). Furthermore, the elastic web products of the present invention have a "gentle" elasticity.

While the product of the present invention has a feel like a knit product, it has better recovery than knits. Moreover, the product of the present invention has a "bouncy" feeling, with good "give" and flexing ability, so that it can advantageously be used in garments. Furthermore, because of the good stretch properties of the product of the present invention, it can advantageously be used in bedding products.

Thus, by the present invention, the following advantageous effects are achieved:

(1) the web material is cloth-like;
(2) when utilizing cellulose fibers hydraulically entangled with the meltblown elastic web, materials can be made that are highly absorbent and cheap;
(3) the hydraulic entanglement can be used to bond dissimilar polymeric fibrous materials;
(4) necessity of thermal or chemical bonding can be eliminated, and even if such bonding is used, the amount of such types of bonding can be reduced;
(5) with the meltblown process, additional treatments can be incorporated (e.g., fiber blending, incorporation of additives, such as particulate material, in the meltblown web, etc.)
(6) by utilizing small fibers in combination with the meltblown elastic web, a terry-cloth (texturing) effect is achieved (that is, there is significant fibers in the Z-direction).

This case is one of a group of cases which are being filed on the same date. The group includes (1) "Nonwoven Fibrous Hydraulically Entangled Elastic Coform Material and Method of Formation Thereof", L. Trimble, et al. application Ser. No. 07/170,196; (2) "Nonwoven Fibrous Hydraulically Entangled Non-Elastic Coform Material and Method of Formation Thereof", F., Radwanski, et al. application Ser. No. 07/170,208; (3) "Hydraulically Entangled Nonwoven Elastomeric Web and Method of Forming the Same", F. Radwanski, et al. application Ser. No. 07/170,209; (4) "Nonwoven Hydraulically Entangled Non-Elastic Web and Method of Formation Thereof", F. Radwanski, et al. application Ser. No. 07/170,200; and (5) "Nonwoven Material Subjected to Hydraulic Jet Treatment in Spots, and Method and Apparatus for Producing the Same", F. Radwanski application Ser. No. 07/170,193. The contents of the other applications in this group, other than the present application, are incorporated herein by reference.

While we have shown and described several embodiments in accordance with the present invention, it is understood that the same is not limited thereto, but is susceptible of numerous changes and modifications as are known to one having ordinary skill in the art, and we therefor do not wish to be limited to the details shown and described herein, but intend to cover all such modifications as are encompassed by the scope of the appended claims.

What is claimed is:

1. A composite nonwoven elastomeric web comprising:

a first fibrous layer including meltblown fibers; and a second fibrous layer;

wherein the fibers of at least one of the layers are elastomeric and the layers are joined by hydraulic entanglement of the fibers of at least one of the layers with the fibers of the other layer and wherein the composite nonwoven elastomeric web has substantially smooth outer surfaces.

2. The composite nonwoven elastomeric web according to claim 1, wherein the second fibrous layer includes fibers selected from the group including pulp fibers, staple fibers and meltblown fibers.

3. The composite nonwoven elastomeric web according to claim 2, wherein the first fibrous layer is a layer of elastomeric meltblown fibers.

4. The composite nonwoven elastomeric web according to claim 3, consisting essentially of said layer of elastomeric meltblown fibers and said second fibrous layer.

5. The composite nonwoven elastomeric web according to claim 3, wherein said second fibrous layer is a web.

6. The composite nonwoven elastomeric web according to claim 2, wherein said pulp fibers are wood pulp fibers.

7. The composite nonwoven elastomeric web according to claim 1, wherein said second fibrous layer is a sheet of paper.

8. The composite nonwoven elastomeric web according to claim 1, wherein said composite includes a third fibrous layer which, in conjunction with said second fibrous layer, sandwich the layer including elastomeric meltblown fibers.

9. The composite nonwoven elastomeric web according to claim 8, wherein at least one of said second and third fibrous layers is a sheet of paper.

10. The composite nonwoven elastomeric web according to claim 8, wherein at least one of said second and third fibrous layers is a layer of pulp fibers.

11. The composite nonwoven elastomeric web according to claim 8, wherein at least one of said second and third fibrous layers is a layer of staple fibers.

12. The composite nonwoven elastomeric web according to claim 1, wherein said staple fibers are polyester staple fibers.

13. The composite nonwoven elastomeric web according to claim 12, wherein the polyester staple fibers are carded.

14. The composite nonwoven elastomeric web according to claim 1, wherein said second fibrous layer includes carded polyester staple fibers.

15. The composite nonwoven elastomeric web according to claim 3, wherein said first fibrous layer includes a web of elastomeric meltblown fibers and a web of polyolefin meltblown fibers so that the first fibrous web is adapted to have barrier properties.

16. The composite nonwoven elastomeric web according to claim 1, having isotropic elastic properties.

17. The composite nonwoven elastomeric web according to claim 3, wherein the first fibrous layer was in stretched configuration during hydraulic entangling so that a corrugated composite web is formed.

18. The composite nonwoven elastomeric web according to claim 1, wherein said second fibrous layer is an admixture of meltblown fibers and at least one material selected from the group including staple fibers, pulp fibers, particulate material and continuous filaments.

19. The composite nonwoven elastomeric web according to claim 1, wherein said admixture further includes a particulate material.

20. The composite nonwoven elastomeric web according to claim 1, wherein said second fibrous layer includes cellulose fibers.

21. The composite nonwoven elastomeric web according to claim 1, wherein said second fibrous layer includes synthetic pulp fibers, the synthetic pulp fibers being not greater than 0.25 inches long and 1.3 denier.

22. The composite nonwoven elastomeric web according to claim 21, wherein the synthetic pulp fibers are polyester pulp fibers.

23. The composite nonwoven elastomeric web according to claim 3, wherein the elastomeric meltblown fibers are selected from the group consisting of polyurethane fibers and polyetherester fibers.

24. The coupling nonwoven elastomeric web according to claim 23, wherein the second fibrous layer includes 15–65% polyester pulp fibers, of the basis weight of the composite web.

25. The composite nonwoven elastomeric web according to claim 24, wherein the composite web has a basis weight of 100–200 g/m$^2$.

26. The composite nonwoven elastomeric web according to claim 1, wherein the web has a terry-cloth surface.

27. A nonwoven elastomeric web formed by hydraulically entangling a layer of meltblown elastomeric fibers.

28. The nonwoven elastomeric web according to claim 27, wherein said meltblown elastomeric fibers are formed of a single elastomeric material.

29. A process of forming a composite nonwoven elastic web comprising:

providing a first fibrous layer including meltblown fibers, directing a plurality of high-pressure liquid streams toward a surface of said first fibrous layer to entangle the fibers of said layer, overlaying said entangled first fibrous layer with a second fibrous layer, wherein the fibers of at least one of the layers are elastomeric; and directing a plurality of high-pressure liquid streams toward a surface of said laminate to entangle the fibers of at least one of the layers with the fibers of the other layer, and wherein the composite nonwoven elastomeric web has substantially smooth outer surfaces.

30. The process according to claim 29 wherein said plurality of high-pressure liquid streams are directed to said surface of said laminate a plurality of times.

31. The process according to claim 29, wherein said of high-pressure liquid streams are directed toward each surface of said laminate.

32. The process according to claim 31, wherein said laminate includes a third fibrous layer which, in conjunction with said second fibrous layer, sandwich the layer including elastomeric meltblown fibers.

33. The product formed by the process of claim 32.

34. The product formed by the process of claim 29.

35. A process of forming a nonwoven elastomeric web comprising the steps of:

providing a layer of meltblown elastomeric fibers; and directing a plurality of high-pressure liquid streams toward a surface of said layer, to entangle said fibers.

36. The process according to claim 35, wherein said meltblown elastomeric fibers are formed of a single material.

37. The formed by the process of claim 35.

38. A process of forming a composite nonwoven elastic web comprising the steps of:

providing a first fibrous layer including elastomeric meltblown fibers, directing a plurality of high-pressure liquid streams toward a surface of said first fibrous layer to entangle the fibers of said layer, overlaying said entangled first fibrous layer with a second non-elastomeric filamentary layer;

directing a plurality of high-pressure liquid streams toward a surface of said laminate to entangle the fibers of at least one of the layers with the filaments of the other layer; and stretching and relaxing the hydraulically entangled composite nonwoven web, and wherein the composite nonwoven elastomeric web has substantially smooth outer surfaces.

39. A composite nonwoven elastomeric web comprising a layer of elastomeric meltblown fibers hydraulically entangled with at least one mechanically worked non-elastomeric filamentary layer.

40. A composite nonwoven elastomeric web comprising a layer of meltblown fibers hydraulically entangled with at least one elastomeric filamentary layer.

* * * * *

UNITED STATES PATENT AND TRADEMARK OFFICE

CERTIFICATE OF CORRECTION

PATENT NO. : 4,939,016

DATED : July 3, 1990

INVENTOR(S) : Fred R. Radwanski, et al

It is certified that error appears in the above-indentified patent and that said Letters Patent is hereby corrected as shown below:

On title page, item [56] References Cited - U.S. PATENT DOCUMENTS, should read --4,775,579 10/1988 Hagy et al. 428/284 --

Column 15, line 34, "to the resultant laminate" should read --to the resultant laminate.--

Column 15, line 37, "fibers (approx 20 g/m²)" should read --fibers (approx. 20 g/m²)--

Column 15, line 52, "(approx 20 g/m²)" should read --(approx. 20 g/m²)--

Column 1, line 34, "binding" should read --bonding--

Column 6, line 51, "force For" should read --force. For--

Column 8, line 44, "quench ing" should read --quenching--

Column 11, line 30, "entanglement" should read --entanglement.--

Column 21, line 16, "claim 1," should read --claim 11,--

Column 21, line 59, "The coupling" should read --The composite--

UNITED STATES PATENT AND TRADEMARK OFFICE

CERTIFICATE OF CORRECTION

PATENT NO. : 4,939,016

DATED : July 3, 1990

INVENTOR(S) : Fred R. Radwanski et al

It is certified that error appears in the above-indentified patent and that said Letters Patent is hereby corrected as shown below:

Column 22, line 44, "The formed" should read --The product formed--

Signed and Sealed this

Seventh Day of December, 1993

*Attest:*

Bruce Lehman

BRUCE LEHMAN

*Attesting Officer*

*Commissioner of Patents and Trademarks*